US011313619B2

(12) United States Patent
Van Willigenburg

(10) Patent No.: US 11,313,619 B2
(45) Date of Patent: Apr. 26, 2022

(54) ETHYLENE PLANT REFRIGERATION SYSTEM

(71) Applicant: SABIC GLOBAL TECHNOLOGIES B.V., Bergen Op Zoom (NL)

(72) Inventor: Joris Van Willigenburg, Geleen (NL)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 174 days.

(21) Appl. No.: 16/473,155

(22) PCT Filed: Dec. 14, 2017

(86) PCT No.: PCT/IB2017/057970

§ 371 (c)(1),
(2) Date: Jun. 24, 2019

(87) PCT Pub. No.: WO2018/122662

PCT Pub. Date: Jul. 5, 2018

(65) Prior Publication Data

US 2019/0331415 A1 Oct. 31, 2019

(30) Foreign Application Priority Data

Jan. 2, 2017 (EP) ..... 17150017

(51) Int. Cl.
*F25J 3/02* (2006.01)

(52) U.S. Cl.
CPC ..... *F25J 3/0219* (2013.01); *F25J 3/0233* (2013.01); *F25J 3/0238* (2013.01); *F25J 3/0252* (2013.01); *F25J 2200/74* (2013.01); *F25J 2205/04* (2013.01); *F25J 2270/12* (2013.01);

(Continued)

(58) Field of Classification Search
CPC ..... F25J 3/0219; F25J 3/0238; F25J 3/0233; F25J 3/0252; F25B 30/02; F25B 41/04; F25B 49/02
See application file for complete search history.

(56) References Cited

U.S. PATENT DOCUMENTS 4,143,521 A * 3/1979 Pano ..... B01J 19/0006 62/101
4,900,347 A 2/1990 McCue, Jr. et al.
(Continued)

FOREIGN PATENT DOCUMENTS

| | | |
|---|---|---|
| CN | 1286671 | 3/2001 |
| CN | 102216710 | 10/2011 |
| CN | 102767936 | 11/2012 |

OTHER PUBLICATIONS

International Search Report and Written Opinion issued in Corresponding International Patent Application No. PCT/IB2017/057970, dated May 3, 2018.

(Continued)

*Primary Examiner* — Brian M King
(74) *Attorney, Agent, or Firm* — Norton Rose Fulbright US LLP

(57) ABSTRACT

A refrigeration system for cooling a charge gas by a binary refrigerant. The refrigeration system comprises n heat exchangers, n compressor stages, at least one separator and a demethanizer. By flowing depressurized refrigerant through all the subsequent heat exchangers and installing interstage coolers, the overall energy for the refrigeration system is reduced.

7 Claims, 3 Drawing Sheets

(52) U.S. Cl.
CPC ..... *F25J 2270/66* (2013.01); *F25J 2270/902* (2013.01); *F25J 2270/906* (2013.01)

(56) References Cited

U.S. PATENT DOCUMENTS

| | | | | |
|---|---|---|---|---|
| 5,979,177 | A * | 11/1999 | Sumner | F25J 3/0233 62/612 |
| 6,560,989 | B1 | 5/2003 | Roberts et al. | |
| 2002/0174679 | A1* | 11/2002 | Wei | F25J 3/0238 62/612 |
| 2008/0141712 | A1* | 6/2008 | Verma | F25J 3/0242 62/620 |
| 2008/0178590 | A1* | 7/2008 | Chillar | F02C 7/12 60/597 |
| 2008/0307789 | A1* | 12/2008 | Mak | F25J 3/0242 60/651 |
| 2011/0146342 | A1* | 6/2011 | Sumner | C09K 5/042 62/619 |
| 2014/0134096 | A1* | 5/2014 | Angelini | C01B 17/0404 423/576.8 |
| 2014/0275674 | A1* | 9/2014 | Verma | C07C 7/167 585/259 |
| 2016/0282043 | A1 | 9/2016 | Sumner | |

OTHER PUBLICATIONS

Partial Search Report issued in Corresponding European Patent Application No. 17150017, dated Oct. 10, 2017.
Office Action issued in counterpart Chinese Patent Application No. 201780086725.9, dated Dec. 1, 2020.

* cited by examiner

ETHYLENE PLANT REFRIGERATION SYSTEM

CROSS-REFERENCE TO RELATED APPLICATIONS

This application is a national phase under 35 U.S.C. § 371 of International Application No. PCT/IB2017/057970, filed Dec. 14, 2017, which claims the benefit of priority of European Patent Application No. 17150017.6, filed Jan. 2, 2017, the entire contents of each of which are hereby incorporated by reference in their entirety.

FIELD OF THE INVENTION

The present invention relates to an ethylene plant refrigeration system.

BACKGROUND OF THE INVENTION

In an ethylene plant, a charge gas such as a pyrolysis gas is typically processed to remove methane and hydrogen by a demethanizer and the remainder is processed in a known manner to separate ethylene. The separation of the gases in an ethylene plant through condensation and fractionation at cryogenic temperatures requires refrigeration over a wide temperature range. The capital cost involved in the refrigeration system of an ethylene plant can be a significant part of the overall plant cost. Therefore, capital savings for the refrigeration system will significantly affect the overall plant cost.

U.S. Pat. No. 5,979,177 discloses a process for the production of ethylene from a charge gas containing hydrogen, methane, ethylene and other C2 and heavier hydrocarbons by a low pressure demethanizer in a refrigeration system. A binary refrigerant comprising a mixture of methane and ethylene is used for the cooling. The binary refrigerant is progressively expanded and cooled through a series of heat exchangers. The charge gas is brought into contact with the cooled binary refrigerant in the heat exchangers to be cooled. The streams of binary refrigerants which have been used in the heat exchangers are compressed by a single compressor and subsequently expanded to be cooled for reusing in the series of heat exchangers.

The compression of the binary refrigerant which has been used in the heat exchangers requires a large amount of energy. It is desirable to be able to provide a refrigeration system which requires less energy.

SUMMARY

In the context of the present invention, fifteen embodiments are now described. Embodiment 1 is a refrigeration system for cooling a charge gas by a binary refrigerant, the refrigeration system comprises n heat exchangers (H-201, H-202,H-203,H-204) for progressively cooling the charge gas (2001) by the binary refrigerant (2501), wherein n is an integer of at least 2, wherein the refrigerant (2501) is successively fed to the first to the nth heat exchanger (H-201,H-202,H-203,H-204), wherein a portion of the refrigerant is expanded to lower the temperature after each of the n heat exchangers to provide first to nth expanded refrigerants (2502,2503,2504,2505), wherein each of the expanded refrigerants is fed back to the series of heat exchangers such that the kth expanded refrigerant (2502, 2503,2504,2505) is successively fed back to the kth to the first heat exchangers (H-204,H-203,H-202,H-201) to provide cooling and result in kth heated refrigerant (2410, 2308, 2206, 2104), wherein k is an integer of 1 to n, wherein the heated refrigerants (2410, 2308, 2206, 2104) have temperatures of 0° C. to 25° C.; n compressor stages (K-111, K-113, K-113, K-114, K-121, K-122, K-123 K-211, K-212, K-213, K-214, K-311, K-312) for compressing the heated refrigerants (2410, 2308, 2206, 2104) arranged such that the output from the mth compressor stage (K-211,K-212,K-213) is fed to the (m+1)th compressor stage (K-212,K-213,K-214) after being cooled by a respective interstage cooler (H-211, H-212, H-213), wherein m is an integer of 1 to (n−1), and the output from the nth compressor stage is fed to the nth interstage cooler (H-214); at least one separator (V-101, V-102, V-103, V-104, V-105, V-110, V-111, V-112, V-113, V-114, V-121, V-122, V-123, V-124, V-201,V-202,V-203, V-204, V-205, V-210, V-211, V-212, V-213, V-214, V-221, V-222, V-224, V-311, V-312) following one of the heat exchangers (H-101, H-102, H-103, H-104, H-105, H-106, H-114, H-115, H-116, H-117, H-123, H-202, H-203, H-204, H-311A, H-311B) for separating the cooled charge gas from the heat exchanger to produce an overhead (2005,2008, 2011) to be fed to the subsequent heat exchanger and a bottoms (2004, 2007,2010); and a demethanizer (C-201) for separating the bottoms (2004, 2007,2010) from the at least one separator into an overhead comprising methane and a bottoms comprising C2+ hydrocarbons.

Embodiment 2 is the refrigeration system of embodiment 1, wherein the kth heated refrigerant (2410, 2308, 2206, 2104) is fed to (n−k+1) th compressor stage (K-211,K-212, K-213,K-214), respectively. Embodiment 3 is the refrigerant system of any of embodiments 1 and 2, wherein the charge gas (2011) from the nth heat exchanger (H-204) is successively fed back to the nth to the 1st heat exchangers without separation, preferably after being cooled. Embodiment 4 is the refrigeration system of any of embodiments 1 and 2, wherein the charge gas (2011) from the nth heat exchanger (H-204) is separated into a stream of H2 and a stream of methane and each of the streams is successively fed back to the nth to the 1st heat exchangers, preferably after the stream of H2 and/or the stream of methane is cooled. Embodiment 5 is the refrigeration system of any of embodiments 1 and 2, wherein the refrigeration system further comprises a charge gas heat exchanger (H-205) for cooling the charge gas (2011) from the nth heat exchanger (H-204) and a separator (V-204) for separating the cooled charge gas from the charge gas heat exchanger (H-205) into a stream of H2 and a stream of methane to be fed back to the charge gas heat exchanger (H-205) and successively to the nth to the first heat exchanger, wherein the stream of methane is expanded to lower the temperature before being fed back to the charge gas heat exchanger (H-205).

Embodiment 6 is the refrigeration system of any of the preceding embodiments, wherein the refrigeration system further comprises a refrigerant heat exchanger (H-206) for cooling and partly condensing the overhead from the demethanizer (C-201) by the refrigerant from the nth heat exchanger (H-204) which has been expanded to lower the temperature before being fed, wherein a vapour fraction of the cooled overhead is successively fed back to the nth to the first heat exchanger and a liquid fraction of the cooled overhead is fed back to the demethanizer (C-201) as reflux, wherein the heated refrigerant from the refrigerant heat exchanger (H-206) is successively fed back to the nth to the first heat exchanger and subsequently to the first compressor stage (K-211). Embodiment 7 is the refrigeration system of any of the preceding embodiments, wherein the refrigeration system further comprises a cooling system for liquefying the binary refrigerant (2561) from the nth interstage cooler (H-223) to provide the refrigerant (2501) to be fed to the first heat exchanger (H-201) as a liquid.

Embodiment 8 is the refrigeration system of embodiment 7, wherein the cooling system for liquefying the binary refrigerant (2561) from the nth interstage cooler (H-223) comprises a series of coolers (H-215, H-216, H-217) for cooling the binary refrigerant (2561) by a propylene refrigerant, a series of compressor stages (K-221,K-222,K-223) for recompressing vapour fractions of the propylene refrigerant used in the coolers and a condenser (H-223) for condensing the propylene refrigerant from the final compressor stage (K-223) to be used by the coolers. Embodiment 9 is the refrigeration system of any of the preceding embodiments, wherein the demethanizer (C-201) is operated at a pressure below 25 bara, for example below 20 bara, for example below 18 bara, for example below 15 bara. Embodiment 10 is the refrigeration system of any of the preceding embodiments, wherein the charge gas (2001) upon entering the first heat exchanger (H-201) has a pressure of at most 30 bara, for example at most 25 bara, for example at most 20 bara, for example at most 18 bara. Embodiment 11 is the refrigeration system of any of the preceding embodiments, wherein each of the interstage coolers (H-221, H-212, H-213, H-214) are cooled by cooling water. Embodiment 12 is the refrigeration system of any of the preceding embodiments, wherein each of the interstage coolers (H-221, H-212, H-213, H-214) are cooled by chilled water originating from an absorption chiller process.

Embodiment 13 is the refrigeration system of any of the preceding embodiments, wherein each of the interstage coolers (H-311A) is followed by a further cooler cooled by chilled water from an absorption chiller (H-311B). Embodiment 14 is the refrigeration system of any of embodiments 12 and 13, wherein the heat required by the absorption chiller is waste heat from a steam cracker process, such as hot quench water from a quench column. Embodiment 15 is a process for cooling a charge gas by a binary refrigerant by the refrigeration system of any of the preceding embodiments.

The use of the word "a" or "an" when used in conjunction with the term "comprising" in the claims and/or the specification may mean "one," but it is also consistent with the meaning of "one or more," "at least one," and "one or more than one."

Throughout this application, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

As used in this specification and claim(s), the phrase "successively fed back to the kth to the first heat exchangers" means that the stream is fed to the kth, (k−1)th, . . . , the second (2nd) and the first (1st) heat exchanger in this order to successively provide cooling to each of the heat exchangers.

As used herein, the term "C# hydrocarbons", wherein "#" is a positive integer, is meant to describe all hydrocarbons having # carbon atoms. C# hydrocarbons are sometimes indicated as just "C#". Moreover, the term "C#+ hydrocarbons" is meant to describe all hydrocarbon molecules having # or more carbon atoms.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DESCRIPTION OF THE DRAWINGS

The following drawings form part of the present specification and are included to further demonstrate certain aspects of the present invention. The invention may be better understood by reference to one or more of these drawings in combination with the detailed description of the specification embodiments presented herein.

FIG. 1 illustrates a refrigeration system for cooling a charge gas (2001) by a binary refrigerant (2501).

DETAILED DESCRIPTION

Figure 1:
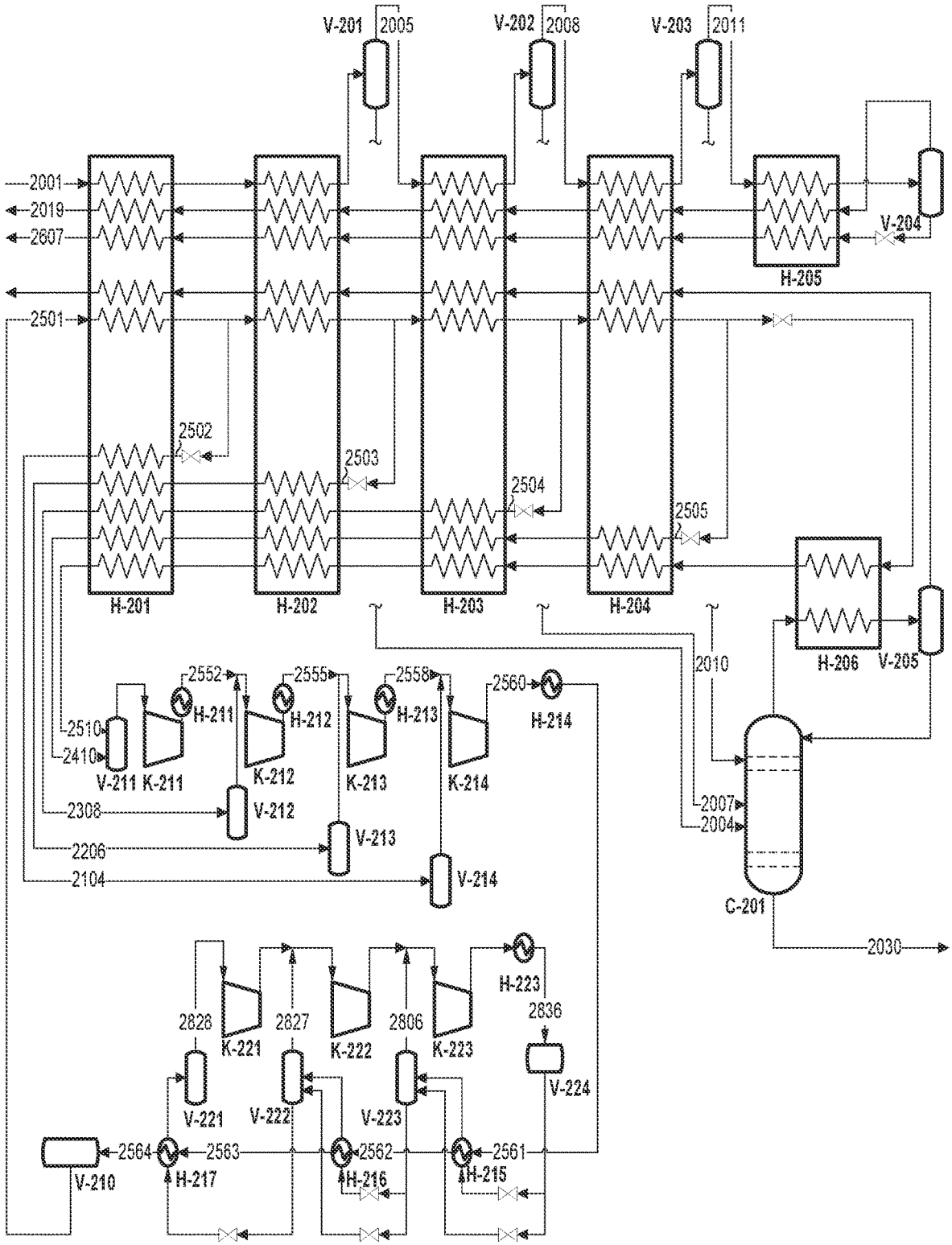
FIG. 1 illustrates an example of a refrigeration system according to the invention.

It is an object of the present invention to provide a refrigeration system and a process in which the above-mentioned and/or other problems are solved. In particular, the purpose of the present invention is to provide the necessary refrigeration for the charge gas to provide a feed for the demethanizer.

Accordingly, the present invention provides a refrigeration system for cooling a charge gas by a binary refrigerant, comprising:

n heat exchangers for progressively cooling the charge gas by the binary refrigerant, wherein n is an integer of at least 2, wherein the refrigerant is successively fed to the first to the nth heat exchanger, wherein a portion of the refrigerant is expanded to lower the temperature after each of the n heat exchangers to provide first to nth expanded refrigerants, wherein each of the expanded refrigerants is fed back to the series of heat exchangers such that the kth expanded refrigerant is successively fed back to the kth to the first heat exchangers to provide cooling and result in kth heated refrigerant, wherein k is an integer of 1 to n, wherein the heated refrigerants have temperatures of 0° C. to 25° C.;

n compressor stages for compressing the heated refrigerants arranged such that the output from the mth compressor stage is fed to the (m+1)th compressor stage after being cooled by a respective interstage cooler, wherein m is an integer of 1 to (n−1), and the output from the nth compressor stage is fed to the nth interstage cooler, at least one separator following one of the heat exchangers for separating the cooled charge gas from the heat exchanger to produce an overhead to be fed to the subsequent heat exchanger and a bottoms and a demethanizer (C-201) for separating the bottoms from the at least one separator into an overhead comprising methane and a bottoms comprising C2+ hydrocarbons.

According to the invention, the expanded refrigerant is fed back successively to all previous heat exchangers in the series to provide cooling. For example, when the system comprises at least four heat exchangers, the fourth expanded refrigerant from the fourth heat exchanger is fed back to the fourth heat exchanger, then the third heat exchanger, then the second heat exchanger and finally the first heat exchanger. It will be understood that the first expanded refrigerant from the first heat exchanger is fed back only to the first heat exchanger. A total of n heated refrigerants in this way come out of the first heat exchanger.

Passing through the heat exchangers to provide cooling to these heat exchangers gradually increases the temperature of the expanded refrigerants, providing heated refrigerants which come out of the first heat exchanger. The heated refrigerants have temperatures of at least 0° C. This allows the heated refrigerants to be cooled e.g. by cooling water after being compressed, as described below. When the heated refrigerants are colder, inter stage cooling will not be possible with cooling water. The heated refrigerants preferably have temperatures of at most 25° C. When the heated refrigerants are hotter, the required compressor power is too high. The heated refrigerants preferably have temperatures of 0-25° C., for example 1-20° C., 2-15° C., 3-10° C. or 4-7° C.

Before feeding to the compressor stages, any liquids that might still be present in the heated refrigerants are preferably separated by vessels to ensure that only vapour is fed to the compressor stages.

Each of the heated refrigerants is fed to a respective compressor stage. The system according to the invention comprises a series of n compressor stages each followed by an interstage cooler. This is arranged such that the output from a compressor stage is fed to the subsequent compressor stage (if present) after being cooled by a respective interstage cooler. Herein, the term "interstage cooler" is understood to include the cooler following the nth (last) compressor stage. The compressed refrigerant from the compressor stage may have a temperature of e.g. 99° C. and is cooled by the respective interstage cooler to a temperature of e.g. 30° C.

Preferably, the kth heated refrigerant is fed to (n−k+1) th compressor stage, respectively. Accordingly, when n is 4, the fourth heated refrigerant is fed to the first compressor stage, the third heated refrigerant is fed to the second compressor stage, the second heated refrigerant is fed to the third compressor stage and the first refrigerant is fed to the fourth compressor stage. The refrigerant from the first compressor stage is cooled by the first interstage cooler and subsequently fed to the second compressor to which the third heated refrigerant is also fed. The mixture of the refrigerant from the first interstage cooler and the third heated refrigerant is compressed in the second compressor stage. The compression and cooling are performed in the same way in the subsequent pairs of compressor stage and interstage cooler. Finally, the cooled refrigerant from the nth interstage cooler is provided, which may be recycled back to the first heat exchanger after possible further cooling.

According to the invention, the expanded refrigerants are fed back successively to all previous heat exchangers to provide cooling and the used refrigerants to be fed to the compressor stages have temperatures of 0-25° C. Such temperatures are high enough to be cooled by interstage coolers using e.g. cooling water. This substantially decreases the total energy required by the compressor stages for providing the refrigerant required for the system. In contrast, in the system of U.S. Pat. No. 5,979,177, the expanded refrigerants are not fed back to all previous heat exchangers, as indicated by the flows of the expanded refrigerants after the valves 78, 98 and 114 in FIG. 1. For example, in the system of U.S. Pat. No. 5,979,177, the flow after the valve 78 is used only for cooling the heat exchanger 6 and not for cooling the heat exchanger 2, and has a temperature of −65° C. After the temperature rise due to compression, the compressor stage outlet temperature will still not be high enough to be cooled by an interstage cooler using cooling water. An interstage cooling could only be achieved with another refrigerant, resulting in no overall benefits from applying inter stage cooling. In the system of U.S. Pat. No. 5,979,177, the refrigerants are compressed by one compressor unit 18 which does not comprise interstage coolers.

The system comprises at least one separator following one of the heat exchangers for separating the cooled charge gas from the heat exchanger. The separator produces an overhead and a bottoms. The overhead is fed to the subsequent heat exchanger. The bottoms is fed to the demethanizer. The demethanizer separates the bottoms into an overhead of primarily methane and a bottoms of C2+ hydrocarbons. Thus, C2+ hydrocarbons are separated out from the charge gas according to the invention. Preferably, the at least one separator comprises a separator following (n−1)th heat exchanger. Preferably, the at least one separator comprises (n−1) separators each respectively following the second to the (n−1)th heat exchanger.

Preferably, the charge gas from the nth heat exchanger is successively fed back to the nth to the 1st heat exchangers. Preferably, the charge gas from the nth heat exchanger is cooled before being fed to the nth heat exchanger. The charge gas from the nth heat exchanger may be separated into a stream of H2 and a stream of methane before being fed to the nth heat exchanger or may be fed to the nth heat exchanger without separation.

Accordingly, in some embodiments, the charge gas from the nth heat exchanger is successively fed back to the nth to the 1st heat exchangers without separation, preferably after being cooled. In some embodiments, the charge gas from the nth heat exchanger is separated into a stream of H2 and a stream of methane and each of the streams is successively fed back to the nth to the 1st heat exchangers, preferably after the stream of H2 and/or the stream of methane is cooled.

Preferably, the system further comprises a charge gas heat exchanger for cooling the charge gas from the nth heat exchanger and a separator for separating the cooled charge gas from the charge gas heat exchanger into a stream of H2 and a stream of methane to be fed back to the charge gas heat exchanger and successively to the nth to the first heat exchanger, wherein the stream of methane is expanded to lower the temperature before being fed back to the charge gas heat exchanger.

In this embodiment, the charge gas from the nth heat exchanger is cooled by a charge gas heat exchanger. The cooled gas is separated by a separator into a stream of H2 and a stream of methane. The stream of H2 is fed back to the charge gas heat exchanger and subsequently successively to the nth to the first heat exchanger. Accordingly, the stream of H2 provides additional cooling to the series of n heat exchangers. The stream of methane is expanded to lower the temperature and subsequently to the charge gas heat exchanger to provide cooling to the charge gas heat exchanger. The stream of methane from the charge gas heat exchanger is subsequently fed successively to the nth to the first heat exchanger. Accordingly, the stream of methane provides additional cooling to the series of n heat exchangers.

Preferably, the system further comprises a refrigerant heat exchanger for cooling and partly condensing the overhead from the demethanizer by the refrigerant from the nth heat exchanger which has been expanded to lower the temperature before being fed, wherein a vapour fraction of the cooled overhead is successively fed back to the nth to the first heat exchanger and a liquid fraction of the cooled overhead is fed back to the demethanizer as reflux.

wherein the heated refrigerant from the refrigerant heat exchanger is successively fed back to the nth to the first heat exchanger and subsequently to the first compressor stage.

In this embodiment, the overhead from the demethanizer (H2 and methane) is cooled by a refrigerant heat exchanger to provide a vapour fraction and a liquid fraction. The cooling is provided by the refrigerant from the nth heat exchanger which has been expanded to lower the temperature before being fed. The vapour fraction of the cooled overhead is successively fed back to the nth to the first heat exchanger. Accordingly, the vapour fraction of the cooled overhead provides additional cooling to the series of n heat exchangers. The refrigerant which provided cooling to the demethanizer overhead is subsequently successively fed back to the nth to the first heat exchanger. Accordingly, the refrigerant from the refrigerant heat exchanger provides additional cooling to the series of n heat exchangers. The resulting heated refrigerant from the first heat exchanger is subsequently to the first compressor stage.

Preferably, the system further comprises a cooling system for liquefying the binary refrigerant from the nth interstage cooler to provide the refrigerant to be fed to the first heat exchanger as a liquid.

Preferably, the cooling system for liquefying the binary refrigerant from the nth interstage cooler comprises a series of coolers for cooling the binary refrigerant by a propylene refrigerant, a series of compressor stages for recompressing vapour fractions of the propylene refrigerant used in the coolers and a condenser for condensing the propylene refrigerant from the final compressor stage to be used by the coolers.

Preferably, n is 2, 3, 4, 5, 6, 7, 8, 9 or 10, more preferably n is 3, 4 or 5, most preferably 4.

Preferably, the demethanizer is operated at a pressure below 25 bara, for example below 20 bara, for example below 18 bara, for example below 15 bara.

Preferably, the charge gas, upon entering the first heat exchanger, has a pressure of at most 30 bara, for example at most 25 bara, for example at most 20 bara, for example at most 18 bara. The charge gas may be partially liquefied.

The binary refrigerant of the present invention comprises methane and ethylene or methane and ethane, preferably methane and ethylene. The ratio of methane to ethylene or ethane may typically be in the range of 10:90 to 50:50 and more likely in the range of 20:80 to 40:60.

Preferably, the interstage coolers are cooled by cooling water.

Preferably, the interstage coolers are cooled by chilled water originating from an absorption chiller.

Preferably, each of the interstage coolers is followed by a further cooler cooled by chilled water from an absorption chiller.

Preferably, the heat required by the absorption chiller is waste heat from a steam cracker process, such as hot quench water from a quench column.

The invention further relates to a process for cooling a charge gas by a binary refrigerant by the system according to the invention.

It is noted that the invention relates to all possible combinations of features described herein, preferred in particular are those combinations of features that are present in the claims. It will therefore be appreciated that all combinations of features relating to the composition according to the invention; all combinations of features relating to the process according to the invention and all combinations of features relating to the composition according to the invention and features relating to the process according to the invention are described herein.

It is further noted that the term 'comprising' does not exclude the presence of other elements. However, it is also to be understood that a description on a product/composition comprising certain components also discloses a product/composition consisting of these components. The product/composition consisting of these components may be advantageous in that it offers a simpler, more economical process for the preparation of the product/composition. Similarly, it is also to be understood that a description on a process comprising certain steps also discloses a process consisting of these steps. The process consisting of these steps may be advantageous in that it offers a simpler, more economical process.

When values are mentioned for a lower limit and an upper limit for a parameter, ranges made by the combinations of the values of the lower limit and the values of the upper limit are also understood to be disclosed.

The invention is elucidated by way of the following drawings, without however being limited thereto.

As shown in FIG. 1, the system comprises four heat exchangers (H-201,H-202,H-203,H-204) for progressively cooling the charge gas (2001) by the binary refrigerant (2501). The refrigerant (2501) is successively fed to the first to the fourth heat exchanger (H-201,H-202,H-203,H-204) to sub cool it. A portion (2501A,2501B,2501C,2501D) of the refrigerant is expanded to lower the temperature after each of the four heat exchangers (H-201,H-202,H-203,H-204) to provide first to fourth expanded refrigerants (2502,2503, 2504,2505).

Each of the expanded refrigerants is fed back to the series of heat exchangers. The fourth expanded refrigerant (2505) is successively fed back to the fourth to the first heat exchangers to provide cooling and results in fourth heated refrigerant (2410). The third expanded refrigerant (2504) is successively fed back to the third to the first heat exchangers to provide cooling and results in third heated refrigerant (2308). The second expanded refrigerant (2503) is successively fed back to the second to the first heat exchangers to provide cooling and results in second heated refrigerant (2206). The first expanded refrigerant (2502) is fed back to the first heat exchangers to provide cooling and results in first heated refrigerant (2104).

The fourth heated refrigerant (2410) is fed to the first compressor stage (K-211), the third heated refrigerant (2308) is fed to the second compressor stage (K-212), the second heated refrigerant (2206) is fed to the third compressor stage (K-213) and the first refrigerant (2104) is fed to the fourth compressor stage (K-214). Before feeding to the compressor stages (K-211,K-212,K-213,K-214), any liquids that might still be present in the heated refrigerant vapours (2410,2308,2206,2104) are separated by vessels (V-211,V-212,V-213,V-214) to ensure that only vapour is fed to the compressor stages.

The refrigerant from the first compressor stage (K-211) is cooled by the first interstage cooler (H-211) and the cooled refrigerant (2552) is subsequently fed to the second compressor stage (K-212) to which the third heated refrigerant (2308) is also fed. The mixture of the cooled refrigerant (2552) and the third heated refrigerant (2308) is compressed in the second compressor stage (K-212). The compression and cooling are performed in the same way in the subsequent pairs (K-213 and H-213; K-214 and H-214) of compressor stage and interstage cooler. Finally, the cooled refrigerant (2561) from the fourth interstage cooler (H-214) is provided.

The system further comprises a cooling system for liquefying the cooled refrigerant (2561) from the fourth interstage cooler (H-214) to provide the refrigerant (2501) to be fed to the first heat exchanger (H-201).

The cooling system for liquefying the binary refrigerant (2561) from the nth interstage cooler (H-223) comprises a series of coolers (H-215, H-216, H-217) for cooling the binary refrigerant (2561) by a propylene refrigerant, a series of compressor stages (K-221,K-222,K-223) for recompressing vapour fractions of the propylene refrigerant used in the coolers and a condenser (H-223) for condensing the propylene refrigerant from the final compressor stage (K-223) to be used by the coolers.

The system further comprises three separators (V-201,V-202,V-203) following the second, third and fourth heat exchangers (H-202,H-203,H-204), respectively. The system further comprises a demethanizer (C-201).

The system further comprises a charge gas heat exchanger (H-205) for cooling the charge gas from the fourth heat exchanger (H-204) and a separator (V-204).

The system further comprises a refrigerant heat exchanger (H-206) for cooling and partly condensing the overhead from the demethanizer (C-201).

The first separator (V-201) separates the cooled charge gas from the second heat exchanger to produce an overhead (2005) to be fed to the third heat exchanger (H-203) and a bottoms (2004) to be fed to the demethanizer (C-201). Likewise, the second separator (V-202) separates the cooled charge gas from the third heat exchanger to produce an overhead (2008) to be fed to the fourth heat exchanger (H-204) and a bottoms (2007) to be fed to the demethanizer (C-201). The third separator (V-203) separates the cooled charge gas from the fourth heat exchanger to produce an overhead (2011) and a bottoms (2010) to be fed to the demethanizer (C-201).

The overhead (2011) from the fourth heat exchanger is fed to the charge gas heat exchanger (H-205) to be cooled. The cooled charge gas from the charge gas heat exchanger (H-205) is separated by the separator (V-204) into a stream of H2 and a stream of methane. The stream of H2 is fed back to the charge gas heat exchanger (H-205) and subsequently successively to the fourth to the first heat exchanger (H-204, H-203,H-202,H-201). The stream of methane is expanded to lower the temperature and subsequently to the charge gas heat exchanger (H-205) to provide cooling to the charge gas heat exchanger (H-205). The stream of methane from the charge gas heat exchanger (H-205) is subsequently fed successively to the fourth to the first heat exchanger (H-204, H-203,H-202,H-201).

The bottoms (2004, 2007,2010) from the separators (V-201,V-202,V-203) are separated by the demethanizer (C-201) into an overhead of H2 and methane and a bottoms (2030) of C2+ hydrocarbons.

The overhead from the demethanizer (C-201) is cooled by the refrigerant heat exchanger (H-206). The cooling is provided by the refrigerant from the fourth heat exchanger which has been expanded to lower the temperature before being fed. The cooled overhead is separated by a separator (V-205) and part of the cooled overhead is successively fed back to the fourth to the first heat exchangers (H-204,H-203,H-202,H-201). The rest of the cooled overhead is fed back to the demethanizer (C-201) as reflux. The refrigerant which provided cooling to the demethanizer overhead is subsequently successively fed back to the fourth to the first heat exchangers (H-204,H-203,H-202,H-201). The resulting heated refrigerant (2510) from the first heat exchanger (H-201) is subsequently fed to the first compressor stage (K-211).

Figure 2:
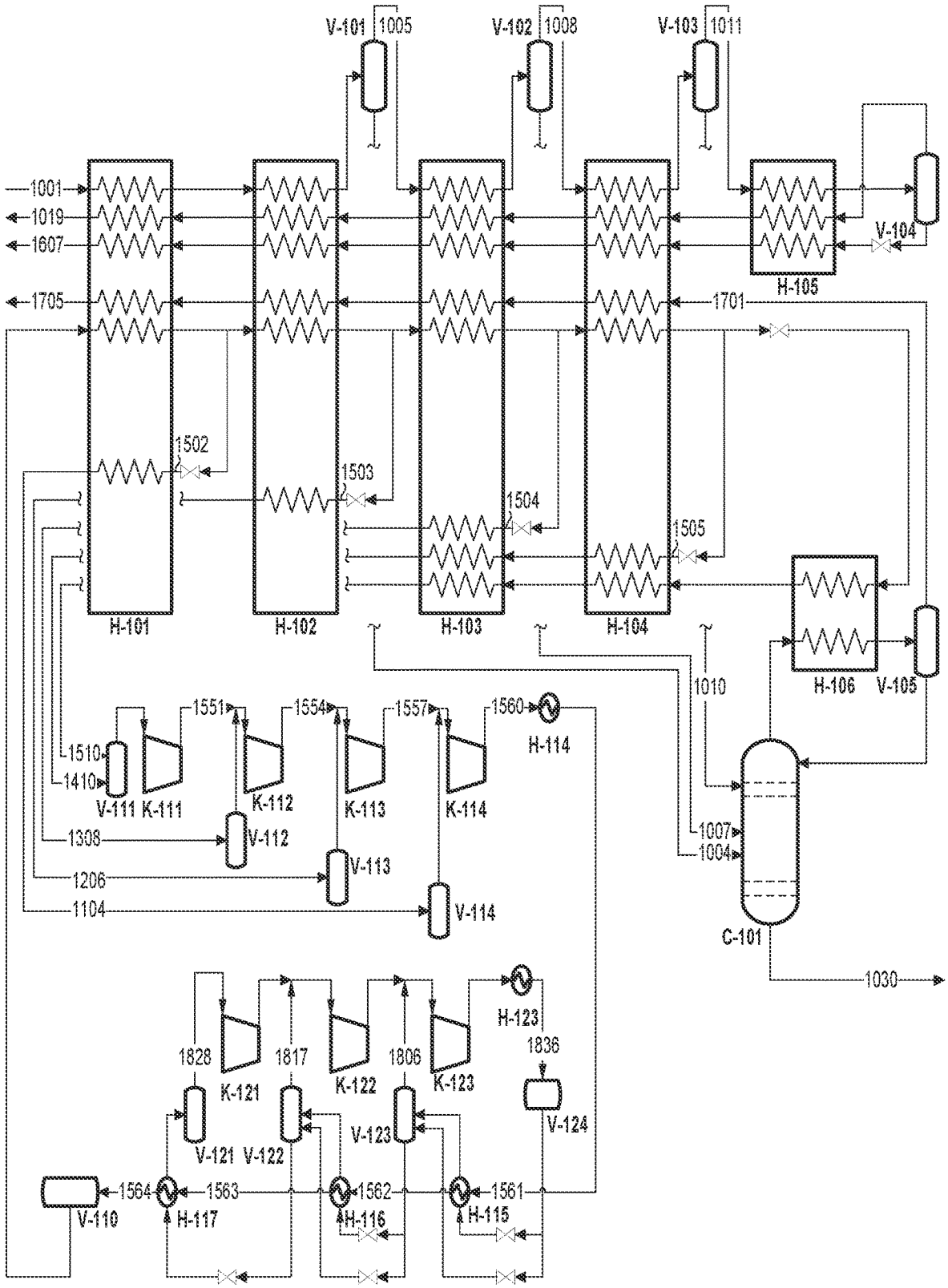
FIG. 2 illustrates an example of a refrigeration system which is not according to the invention and FIG. 3 illustrates a further example of the part of the refrigeration system according to the invention for cooling the heated refrigerant.

FIG. 2 illustrates an example of a refrigeration system which is not according to the invention. FIG. 2 is identical to FIG. 1 except that the portion of the refrigerant from heat exchangers (H-101,H-102,H-103,H-104) which is expanded (1502,1503,1504,1505) and fed back to cool the heat exchanger is not fed to all previous heat exchangers in the series. The refrigerant (1506) from the refrigerant heat exchanger (H-206) is also not fed back to all heat exchangers. Further, the system does not comprise interstage coolers after the compressor stages (K-111,K-112,K-113,K-114).

In this example, the expanded refrigerant (1503) from the second heat exchanger (H-102) is fed back only to the second heat exchanger (H-102). The expanded refrigerant (1504) from the third heat exchanger (H-103) is fed back only to the third heat exchanger (H-103). The expanded refrigerant (1505) from the fourth heat exchanger (H-104) is fed back only to the fourth heat exchanger (H-104) and the third heat exchanger (H-103). The refrigerant (1506) from the refrigerant heat exchanger (H-206) is fed back only to the fourth heat exchanger (H-104) and the third heat exchanger (H-103). Accordingly, the refrigerants to be fed to the compressor stages (1410,1308,1206,1104,1510) have not been extensively used for cooling and still have low temperatures. These refrigerants cannot be cooled by cooling water due to their low temperatures. This is similar to the system of FIG. 1 of U.S. Pat. No. 5,979,177.

A simulation has been performed using the systems of FIGS. 1 and 2, wherein the charge gas stream 2001 or 1001 contains 100 t/h of ethylene and 230.1 t/h of hydrogen, methane, acetylene, ethane, methyl acetylene, propadiene, propylene and propane. The respective amounts are indicated in Table 1 and 4.

The charge gas having a temperature of −37° C. is cooled in the series of heat exchangers as shown in Table 1 and 4. The cooling of the charge gas from −37° C. to −72° C., and then to −91° C., and then to −132° C. is the same as the cooling of the charge gas in the system of U.S. Pat. No. 5,979,177.

The calculated data on the binary refrigerant and propylene refrigerant required for providing such cooling by the system of FIG. 1 is shown in Tables 2 and 3. The calculated data on the binary refrigerant and propylene refrigerant required for providing such cooling by the system of FIG. 2 is shown in Tables 5 and 6.

TABLE 1

| Process data | | | | | | | | | | | | | |
|---|---|---|---|---|---|---|---|---|---|---|---|---|---|
| Stream no. | | 2001 | 2004 | 2005 | 2007 | 2008 | 2010 | 2011 | 2019 | 2030 | 2607 | 2701 | 2705 |
| Pressure | $bar_a$ | 25.0 | 24.5 | 24.5 | 24.3 | 24.3 | 24.0 | 24.0 | 22.5 | 9.3 | 3.7 | 9.0 | 8.0 |
| Temperature | ° C. | −37 | −72 | −72 | −91 | −91 | −132 | −132 | 5 | −43 | 5 | −127 | 5 |
| Mass Flow | t/h | 230.1 | 181.0 | 49.1 | 11.2 | 37.9 | 23.8 | 14.1 | 4.5 | 181 | 9.6 | 35.0 | 35.0 |
| Component Mass Fraction | | | | | | | | | | | | | |
| Hydrogen | —/— | 0.02 | 0.00 | 0.07 | 0.00 | 0.09 | 0.00 | 0.24 | 0.76 | 0.00 | 0.00 | 0.00 | 0.00 |
| Methane | —/— | 0.20 | 0.09 | 0.57 | 0.18 | 0.69 | 0.66 | 0.74 | 0.24 | 0.00 | 0.98 | 1.00 | 1.00 |
| Acetylene | —/— | 0.00 | 0.00 | 0.00 | 0.01 | 0.00 | 0.00 | 0.00 | 0.00 | 0.01 | 0.00 | 0.00 | 0.00 |
| Ethylene | —/— | 0.43 | 0.47 | 0.30 | 0.64 | 0.20 | 0.31 | 0.01 | 0.00 | 0.55 | 0.02 | 0.00 | 0.00 |
| Ethane | —/— | 0.08 | 0.09 | 0.03 | 0.10 | 0.02 | 0.02 | 0.00 | 0.00 | 0.10 | 0.00 | 0.00 | 0.00 |
| Propadiene | —/— | 0.00 | 0.00 | 0.00 | 0.00 | 0.00 | 0.00 | 0.00 | 0.00 | 0.00 | 0.00 | 0.00 | 0.00 |
| Methylacethylene | —/— | 0.00 | 0.01 | 0.00 | 0.00 | 0.00 | 0.00 | 0.00 | 0.00 | 0.01 | 0.00 | 0.00 | 0.00 |
| Propylene | —/— | 0.25 | 0.31 | 0.02 | 0.08 | 0.00 | 0.00 | 0.00 | 0.00 | 0.32 | 0.00 | 0.00 | 0.00 |
| Propane | —/— | 0.01 | 0.01 | 0.00 | 0.00 | 0.00 | 0.00 | 0.00 | 0.00 | 0.01 | 0.00 | 0.00 | 0.00 |

TABLE 2

| Binary refrigerant system data | | | | | | | | | | | | | | |
|---|---|---|---|---|---|---|---|---|---|---|---|---|---|---|
| Stream no. | | 2104 | 2206 | 2308 | 2410 | 2510 | 2552 | 2555 | 2558 | 2560 | 2561 | 2562 | 2563 | 2564 |
| Pressure | $bar_a$ | 16.0 | 8.0 | 5.0 | 1.2 | 1.2 | 5.0 | 8.0 | 16.0 | 45.0 | 45.0 | 45.0 | 45.0 | 45.0 |
| Temperature | ° C. | 5 | 5 | 5 | 5 | 5 | 30 | 30 | 30 | 99 | 30 | 5 | −20 | −40 |
| Mass Flow | t/h | 76.3 | 1.0 | 11.3 | 11.2 | 43.8 | 55.0 | 66.3 | 67.3 | 144 | 144 | 144 | 144 | 144 |

Ethylene mass fraction: 0.77 Methane mass fraction: 0.23

TABLE 3

| Propylene refrigerant data | | | | | |
|---|---|---|---|---|---|
| Stream no. | | 2806 | 2817 | 2828 | 2836 |
| Pressure | $bar_a$ | 6.0 | 2.8 | 1.2 | 16.0 |
| Temperature | ° C. | 1 | −23 | −44 | 39 |
| Mass Flow | t/h | 82.7 | 53.8 | 88.7 | 225 |

The duty of the binary refrigerant compressor stages K-211 through 214 is 11.1 MWmech and for the propylene compressor stages K-221 through K-223 it is 7.2 MWmech, together 18.3 MWmech.

TABLE 4

| Process data | | | | | | | | | | | | | |
|---|---|---|---|---|---|---|---|---|---|---|---|---|---|
| Stream No | | 1001 | 1004 | 1005 | 1007 | 1008 | 1010 | 1011 | 1019 | 1030 | 1607 | 1701 | 1705 |
| Pressure | $bar_a$ | 25 | 24.5 | 24.5 | 24.25 | 24.25 | 24 | 24 | 22.5 | 9.3 | 3.7 | 9 | 8 |
| Temperature | ° C. | −37 | −72 | −72 | −91 | −91 | −132 | −132 | 5 | −43 | 5 | −127 | 5 |
| Mass Flow | t/h | 230.1 | 181.0 | 49.1 | 11.2 | 37.9 | 23.8 | 14.1 | 4.5 | 181.0 | 9.6 | 35.0 | 35.0 |
| Component Mass Fraction | | | | | | | | | | | | | |
| Hydrogen | —/— | 0.02 | 0.00 | 0.07 | 0.00 | 0.09 | 0.00 | 0.24 | 0.76 | 0.00 | 0.00 | 0.00 | 0.00 |
| Methane | —/— | 0.20 | 0.09 | 0.57 | 0.18 | 0.69 | 0.66 | 0.74 | 0.24 | 0.00 | 0.98 | 1.00 | 1.00 |
| Acetylene | —/— | 0.00 | 0.00 | 0.00 | 0.01 | 0.00 | 0.00 | 0.00 | 0.00 | 0.01 | 0.00 | 0.00 | 0.00 |
| Ethylene | —/— | 0.43 | 0.47 | 0.30 | 0.64 | 0.20 | 0.31 | 0.01 | 0.00 | 0.55 | 0.02 | 0.00 | 0.00 |
| Ethane | —/— | 0.08 | 0.09 | 0.03 | 0.10 | 0.02 | 0.02 | 0.00 | 0.00 | 0.10 | 0.00 | 0.00 | 0.00 |
| Propadiene | —/— | 0.00 | 0.00 | 0.00 | 0.00 | 0.00 | 0.00 | 0.00 | 0.00 | 0.00 | 0.00 | 0.00 | 0.00 |
| Methylacethylene | —/— | 0.00 | 0.01 | 0.00 | 0.00 | 0.00 | 0.00 | 0.00 | 0.00 | 0.01 | 0.00 | 0.00 | 0.00 |
| Propylene | —/— | 0.25 | 0.31 | 0.02 | 0.08 | 0.00 | 0.00 | 0.00 | 0.00 | 0.32 | 0.00 | 0.00 | 0.00 |
| Propane | —/— | 0.01 | 0.01 | 0.00 | 0.00 | 0.00 | 0.00 | 0.00 | 0.00 | 0.01 | 0.00 | 0.00 | 0.00 |

TABLE 5

| Binary refrigerant system data | | | | | | | | | | | | | | |
|---|---|---|---|---|---|---|---|---|---|---|---|---|---|---|
| Stream No. | | 1104 | 1206 | 1308 | 1410 | 1510 | 1551 | 1554 | 1557 | 1560 | 1561 | 1562 | 1563 | 1564 |
| Pressure | $bar_a$ | 16 | 8 | 5 | 1.2 | 1.2 | 5 | 8 | 16 | 45 | 45 | 45 | 45 | 45 |
| Temperature | ° C. | 5 | −65 | −75 | −106 | −106 | −21 | 17 | 70 | 117 | 30 | 5 | −20 | −40 |
| Mass Flow | t/h | 98.0 | 10.0 | 11.3 | 11.2 | 43.8 | 55.0 | 66.3 | 76.3 | 174 | 174 | 174 | 174 | 174 |

Ethylene mass fraction: 0.77 Methane mass fraction: 0.23

TABLE 6

| Propylene refrigeration system data | | | | | |
|---|---|---|---|---|---|
| | | 1806 | 1817 | 1828 | 1836 |
| Pressure | $bar_a$ | 6 | 2.8 | 1.2 | 16 |
| Temperature | ° C. | 1 | −23 | −44 | 39 |
| Mass Flow | t/h | 100 | 65 | 108 | 273 |

The required compressor power by the binary refrigerant system is 11.5 MWmech and the propylene compressor 8.7 MWmech, giving a total duty of 20.2 MWmech required for the refrigeration.

The system of FIG. 1 differs from the system of FIG. 2 and the system described in U.S. Pat. No. 5,979,177 by:

A higher inlet temperature of the binary refrigerant entering the compressor stages (K-211,K-212,K-213,K-214);

The presence of compressor interstage coolers (H-211,H-212,H-213) in the binary refrigeration system;

A lower refrigerant demand by the heat exchangers (H-201,H-202,H-203,H-204, H-205).

A higher fraction of heat removed in the binary refrigerant system by the compressor interstage coolers (H-211,H-212,H-213), which results in lower power requirements by the propylene refrigerant compressors (K-221, K222,K-223).

Consequently, comparing the system of FIGS. 1 and 2, there is a saving of 9% compressor power by the system of FIG. 1 according to the invention (18.3 MWmech vs 20.2 MWmech).

Figure 3:
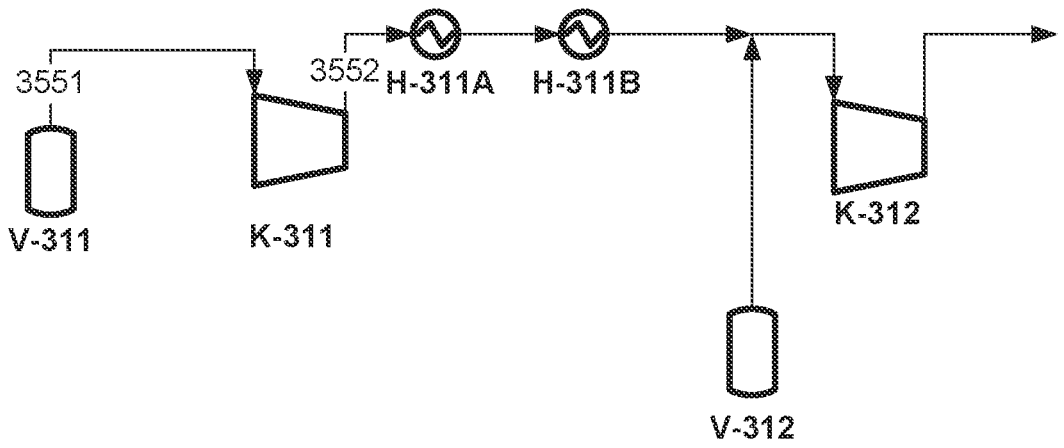

FIG. 3 illustrates an example of the part of the binary refrigeration system according to the invention for cooling the heated refrigerant.

FIG. 3 corresponds to the part of FIG. 1 which includes V-211, K-211, H-211, V-212 and K-212, wherein the relationship between the elements of FIG. 3 and FIG. 1 are: V-311=V-211, K-311=K-211, H-211=K-311A, V-212=V-312 and K-212=K-312. In this example of FIG. 3, there is an additional element which is a secondary interstage cooler H-311B using chilled water generated by an absorption cooling machine. In this example, refrigerant (3551) from compressor suction drum (V-311) enters compressor stage (K-311) and is cooled by a primary interstage cooler (H-311A) using cooling water and subsequently further cooled by a secondary interstage cooler (H-311B) using chilled water, before being fed to the next compressor stage. Similar additions may be made after the other interstage coolers.

The invention claimed is:

1. A refrigeration system for cooling a charge gas by a binary refrigerant, comprising:

n heat exchangers for progressively cooling the charge gas by the binary refrigerant, wherein n is an integer of at least 2, wherein the refrigerant is successively fed to a first to the nth heat exchangers, wherein a portion of the refrigerant is expanded to lower the temperature after each of the n heat exchangers to provide first to nth expanded refrigerants, wherein each of the expanded refrigerants is fed back to the n heat exchangers such that a kth expanded refrigerant is successively fed back to a kth to the first heat exchangers to provide cooling and result in a kth heated refrigerant, wherein k is an integer of 1 to n, wherein the kth heated refrigerant has a temperature of from 0° C. to 25° C., n compressor stages for compressing the kth heated refrigerant arranged such that the output from an mth compressor stage is fed to an (m+1)th compressor stage after being cooled by a respective interstage cooler, wherein m is an integer of 1 to (n−1), and the output from an nth compressor stage is fed to an nth interstage cooler, at least one separator following one of the heat exchangers for separating the cooled charge gas from said heat exchanger to produce an overhead to be fed to the subsequent heat exchanger and a bottoms, and a demethanizer for separating the bottoms from the at least one separator into an overhead comprising methane and a bottoms comprising C2+ hydrocarbons, a separator for separating the charge gas from the nth heat exchanger is into a stream consisting essentially of $H_2$ and a stream consisting essentially of methane and feeds to feed each of the stream consisting essentially of $H_2$ and a stream consisting essentially of methane successively back to the nth to the 1st heat exchangers after the stream of $H_2$ is cooled, and a cooling system for liquefying the binary refrigerant from the nth interstage cooler to provide the refrigerant to be fed to the first heat exchanger as a liquid;

wherein each of the interstage coolers are cooled by chilled water originating from an absorption chiller process; and wherein the cooling system for liquefying the binary refrigerant from the nth interstage cooler comprises a series of coolers for cooling the binary refrigerant by a propylene refrigerant, a series of compressor stages for recompressing vapor fractions of the propylene refrigerant used in said coolers and a condenser for condensing the propylene refrigerant from the final compressor stage to be used by said coolers.

2. The refrigeration system according to claim 1, further comprising a refrigerant heat exchanger for cooling and partly condensing the overhead from the demethanizer by the refrigerant from the nth heat exchanger which has been expanded to lower the temperature.

3. A process for cooling a charge gas by a binary refrigerant by the system according to claim 1.

4. The refrigeration system according to claim 1, wherein each of the interstage coolers is followed by a further cooler cooled by chilled water from an absorption chiller.

5. The refrigeration system according to claim 1, further comprising a cooling system for liquefying the binary refrigerant from the nth interstage cooler to provide the refrigerant to be fed to the first heat exchanger as a liquid.

6. The refrigeration system according to claim 1, further comprising a refrigerant heat exchanger for cooling and partly condensing the overhead from the demethanizer by the refrigerant from the nth heat exchanger which has been expanded to lower the temperature before being fed, wherein a vapour fraction of the cooled overhead is successively fed back to the nth to the first heat exchanger and a liquid fraction of the cooled overhead is fed back to the demethanizer as reflux, wherein the heated refrigerant from the refrigerant heat exchanger is successively fed back to the nth to the first heat exchanger and subsequently to the first compressor stage.

7. A process for cooling a charge gas by a binary refrigerant by the system according to claim 1, wherein the charge gas has a temperature consisting of −37° C.

* * * * *